US009192247B1

(12) United States Patent
Lu

(10) Patent No.: US 9,192,247 B1
(45) Date of Patent: Nov. 24, 2015

(54) BABY WALKER

(71) Applicant: Li-Wei Lu, Taichung (TW)

(72) Inventor: Li-Wei Lu, Taichung (TW)

( * ) Notice: Subject to any disclaimer, the term of this patent is extended or adjusted under 35 U.S.C. 154(b) by 0 days.

(21) Appl. No.: 14/456,578

(22) Filed: Aug. 11, 2014

(51) Int. Cl.
*B62B 7/00* (2006.01)
*A47D 13/04* (2006.01)
*A47D 13/10* (2006.01)

(52) U.S. Cl.
CPC ..... *A47D 13/043* (2013.01); *A47D 13/102* (2013.01)

(58) Field of Classification Search
CPC ..... A47D 13/043; A47D 13/102; A47D 1/08; A47D 9/00; A47D 9/02; B60B 33/0049
See application file for complete search history.

(56) References Cited

U.S. PATENT DOCUMENTS

| | | | | | |
|---|---|---|---|---|---|
| 174,793 | A * | 3/1876 | Erikson | 297/6 |
| 287,721 | A * | 10/1883 | Ranney | 5/106 |
| 529,359 | A * | 11/1894 | Bradish | 297/131 |
| 5,636,853 | A * | 6/1997 | Huang | 280/30 |
| 5,845,963 | A * | 12/1998 | Huang | 297/131 |
| 5,938,218 | A * | 8/1999 | Chuang | 280/87.051 |
| 6,123,300 | A * | 9/2000 | Chen | 248/188.8 |
| 6,224,077 | B1 * | 5/2001 | Sheng | 280/87.051 |
| 6,513,869 | B1 * | 2/2003 | Wu | 297/130 |
| 6,704,949 | B2 * | 3/2004 | Waldman et al. | 5/93.1 |
| 6,728,980 | B1 * | 5/2004 | Chen | 5/93.1 |
| 6,961,968 | B2 * | 11/2005 | Clapper et al. | 5/93.1 |
| 7,007,959 | B1 * | 3/2006 | Lu | 280/87.051 |
| 7,055,836 | B2 * | 6/2006 | Cheng | 280/87.051 |
| 7,070,188 | B2 * | 7/2006 | Waldman et al. | 280/31 |
| 8,240,699 | B2 * | 8/2012 | Zhong et al. | 280/647 |
| 8,998,227 | B1 * | 4/2015 | Chen | 280/87.051 |
| 9,033,351 | B2 * | 5/2015 | Sejnowski et al. | 280/87.051 |
| 2002/0089140 | A1 * | 7/2002 | Lu | 280/87.051 |
| 2003/0137130 | A1 * | 7/2003 | Chang | 280/641 |
| 2004/0075231 | A1 * | 4/2004 | Hou et al. | 280/87.051 |
| 2005/0005353 | A1 * | 1/2005 | Waldman et al. | 5/101 |
| 2012/0326409 | A1 * | 12/2012 | Corso et al. | 280/87.051 |
| 2015/0108731 | A1 * | 4/2015 | Asfa, Amirmasood | 280/87.051 |

* cited by examiner

*Primary Examiner* — Brodie Follman
(74) *Attorney, Agent, or Firm* — Egbert Law Offices, PLLC

(57) ABSTRACT

A baby walker includes a lower frame and an upper frame mounted onto the lower frame via a folding device, wherein the upper frame is provided to load the body weight of the user. The lower frame has multiple roller assemblies universally mounted on a bottom thereof and two parallel foldable rocking devices mounted on the bottom of the lower frame. Each rocking device includes a first seat and a second seat respectively securely mounted on the bottom of the lower frame. A rocking plate has two opposite ends respectively pivotally mounted into a corresponding one of the first seat and the second seat. The rocking plate has a straight side and a corresponding curved side. The first seat holds the rocking plate in place when the rocking is vertical and horizontal relative to the supporting face of the baby walker.

12 Claims, 10 Drawing Sheets

BABY WALKER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a baby walker, and more particularly to a baby walker that can be used as a rocking chair.

2. Description of Related Art Including Information Disclosed Under 37 CFR 1.97 and 37 CFR 1.98.

A baby desires to stand and walk due to his/her instinct when he/she grows up to about 9 or 10 months old. Parents always prepare a baby walker to support the baby because, now, the baby cannot stand and walk well such that he/she may stumble and be hurt. The baby can be gradually used to stand by his/her legs due to a suitable baby walker. As a result, a baby walker is an indispensable good partner during a baby growing up. However, the conventional baby walker has only function and cannot satisfy the multi-requirements of the modern parents. Consequently, the baby walker manufacturers try to provide some new functions to attract the attention of consumers, such as adding toys on an upper frame of the baby walker or providing sound and light effects to the baby walker. However, the baby walker with the function of rocking chair is the best one because the movement simulating on a rocking horse can train the muscle coordination of his/her body. This design promotes the function of the baby walker. However, the conventional baby walker with the function of rocking chair has some disadvantages that need to be advantageously altered.

The conventional baby walker needs to disassembled and assembled with a different lower frame when changing the functions of baby walker and rocking chair. It is very difficult for some mothers. In addition, the structures may lose their precision fit after being frequently disassembled and assembled. Consequently, the positioning effect of the conventional baby walker is weak. The shock occurred due to the weak positioning effect may terrify the baby during operation, and even hurt the baby. It is very important to choose a good baby walker.

The present invention has arisen to mitigate and/or obviate the disadvantages of the conventional baby walker.

BRIEF SUMMARY OF THE INVENTION

The main objective of the present invention is to provide an improved baby walker that also can be used as a rocking chair.

To achieve the objective, the baby walker in accordance with the present invention comprises a lower frame and an upper frame mounted onto the lower frame via a folding device, wherein the upper frame is provided to load the body weight of the user. The lower frame has multiple roller assemblies universally mounted on a bottom thereof and two parallel foldable rocking devices mounted on the bottom of the lower frame. Each roller assembly includes a seat securely mounted on the bottom of the lower frame, an arm pivotally mounted on the seat and a roller rotatably mounted to a free end of the arm, wherein the seat holds the arm in place when the arm vertically and horizontally corresponds to a supporting face of the baby walker. Each rocking device includes a first seat and a second seat respectively securely mounted on the bottom of the lower frame. A rocking plate has two opposite ends respectively pivotally mounted into a corresponding one of the first seat and the second seat. The rocking plate has a straight side and a corresponding curved side, wherein the straight side of the rocking plate includes two opposite ends respectively having a first axle and a second axle horizontally extending therefrom. The first axle and the second axle are respectively rotatably received in the first seat and the second seat. The first seat holds the rocking plate in place when the rocking plate is vertical and horizontal relative to the supporting face of the baby walker.

Further benefits and advantages of the present invention will become apparent after a careful reading of the detailed description with appropriate reference to the accompanying drawings.

DETAILED DESCRIPTION OF THE INVENTION

Figure 1:
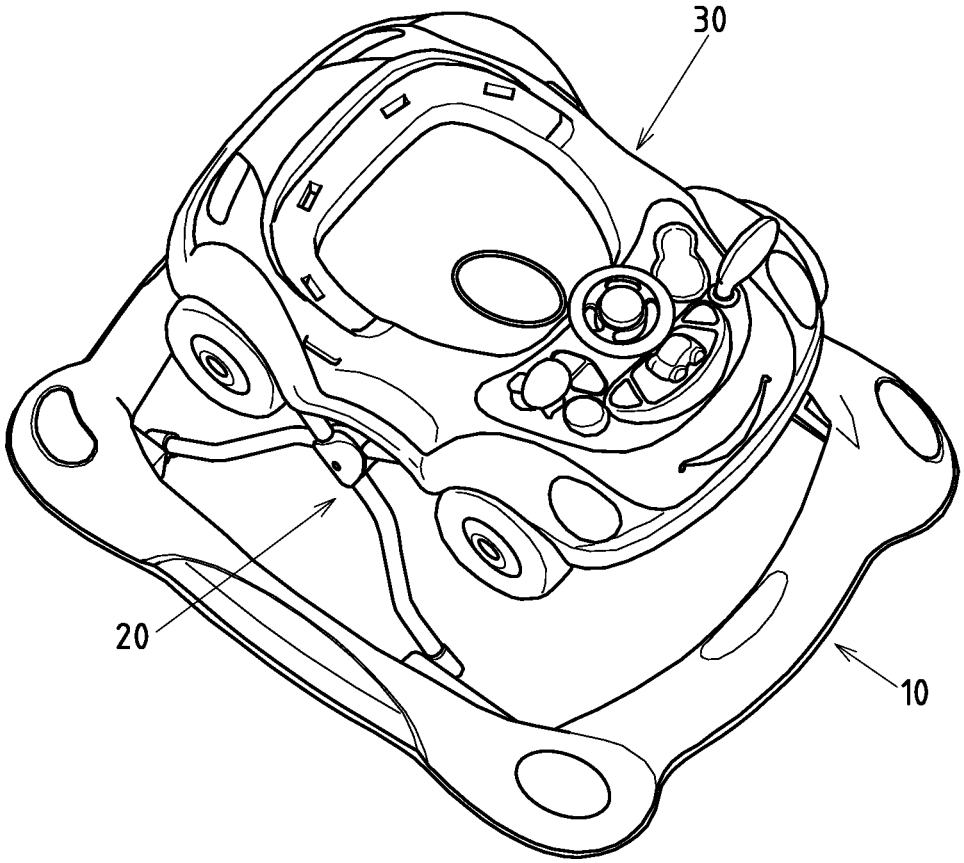
FIG. 1 is a perspective view of a baby walker in accordance with the present invention.
Figure 2:
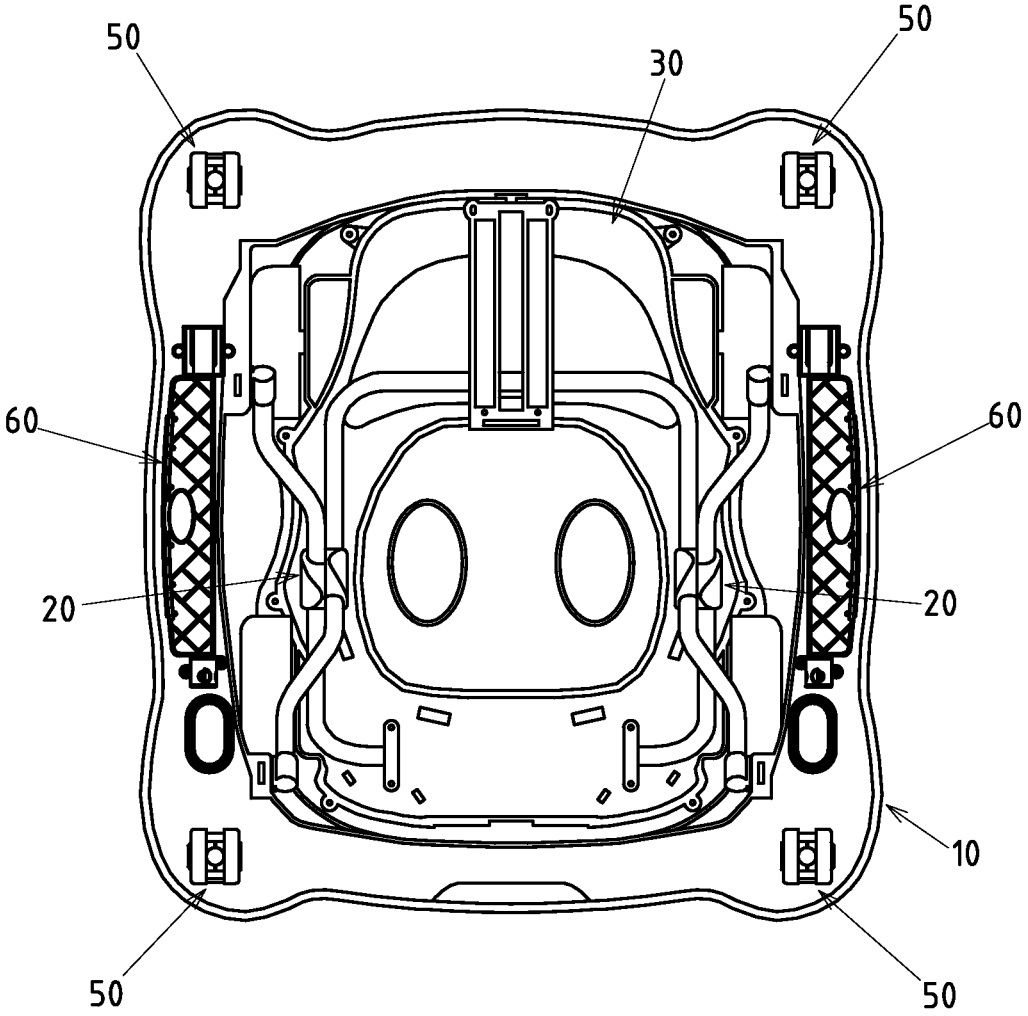
FIG. 2 is a bottom plan view of a baby walker in FIG. 1.

With reference to FIGS. 1 and 2, the baby walker in accordance with the present invention comprises a lower frame 10 and an upper frame 30 mounted onto the lower frame 10 via a folding device 20, wherein the upper frame 30 is provided to load the body weight of the user, the lower frame 10 has multiple roller assemblies 50 universally mounted on a bottom thereof and there are two parallel foldable rocking devices 60 mounted on the bottom of the lower frame 10. The baby walker in accordance with the present invention is used as a general baby walker when the two rocking devices 60 are folded and the baby walker in accordance with the present invention is used as a rocking chair when the two rocking devices 60 are stretched for providing a multi-functional baby walker.

Figure 3:
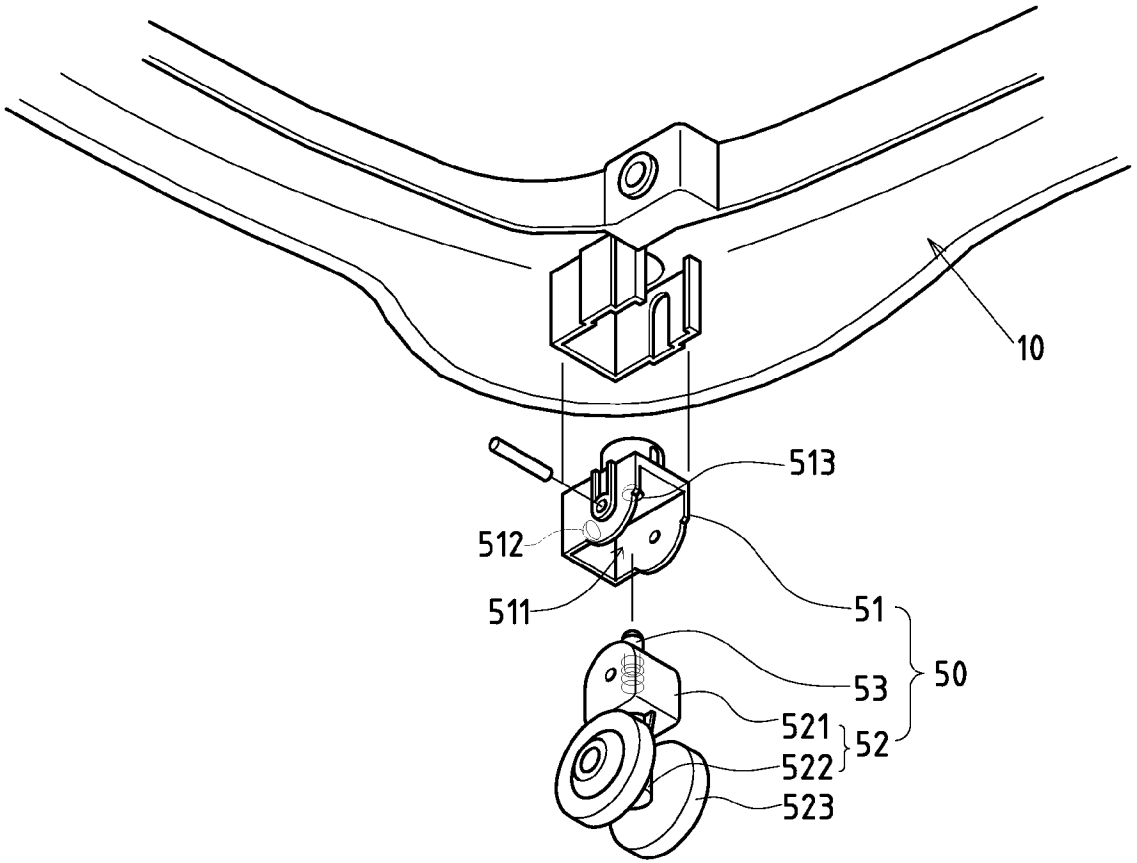
FIG. 3 is an exploded perspective view of a roller assembly of the baby walker in accordance with the present invention.
Figure 4:
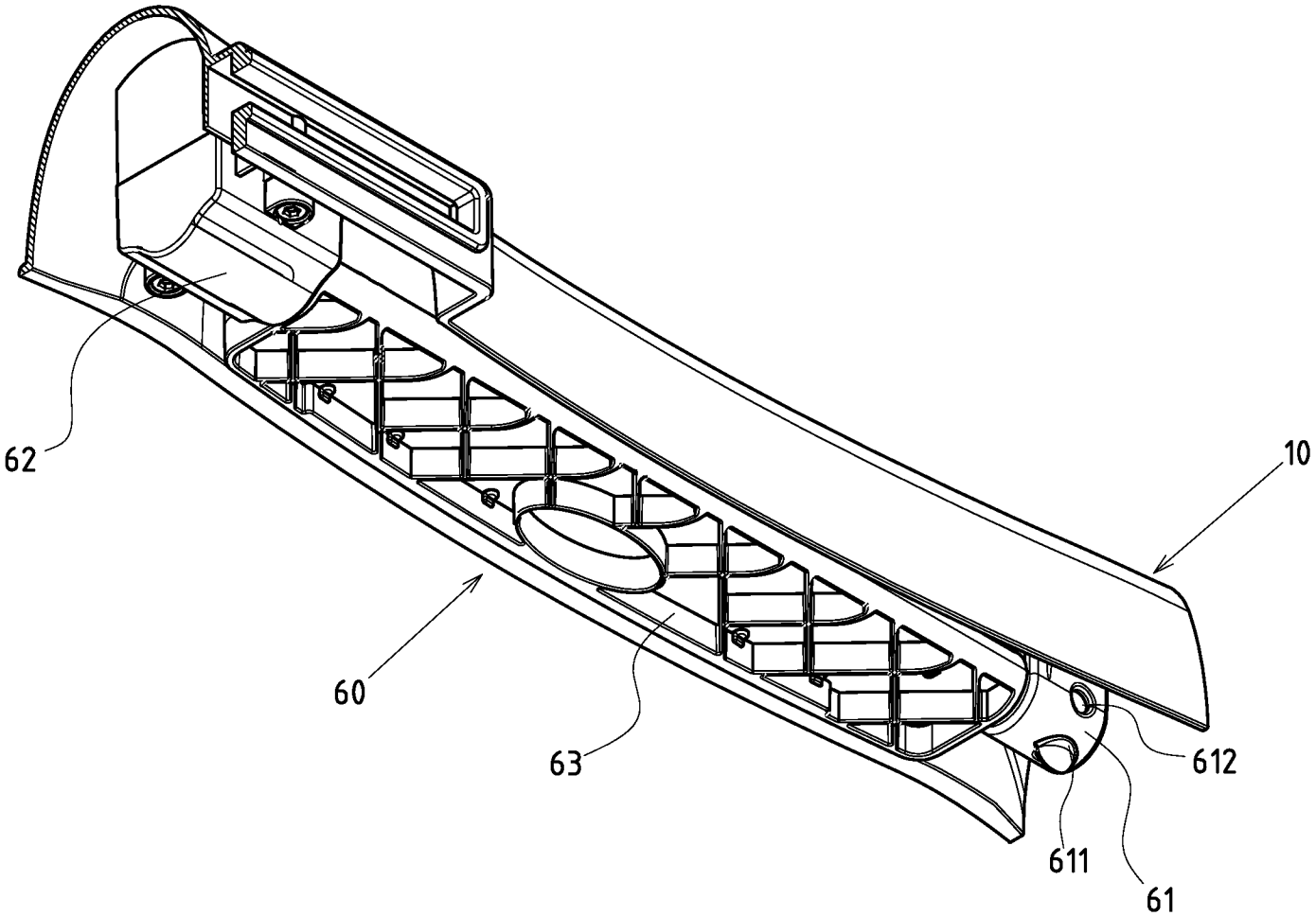
FIG. 4 is a perspective view of a rocking device of the baby walker in accordance with the present invention.
Figure 5:
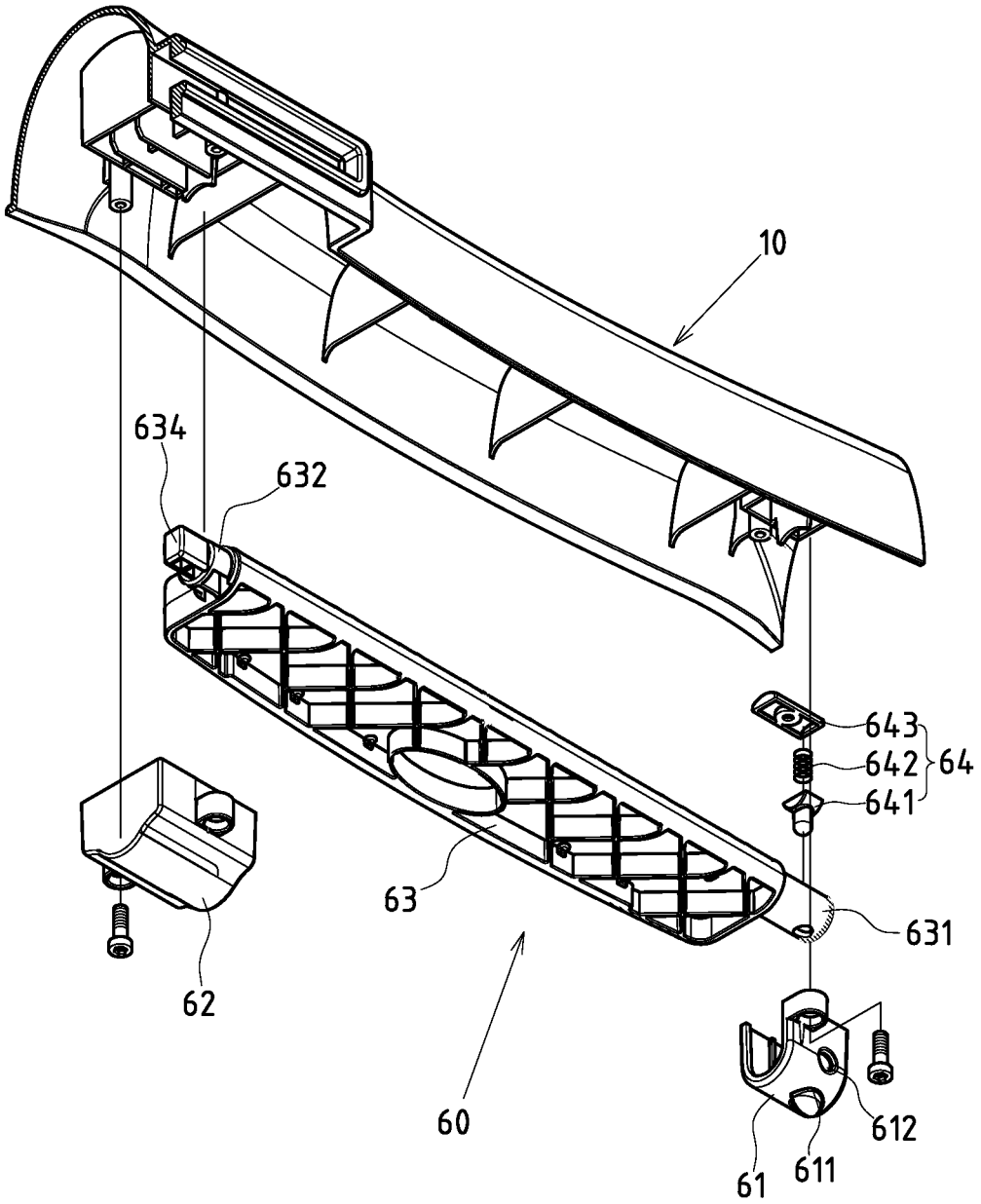
FIG. 5 is an exploded perspective view of the rocking device in FIG. 4.
Figure 6:
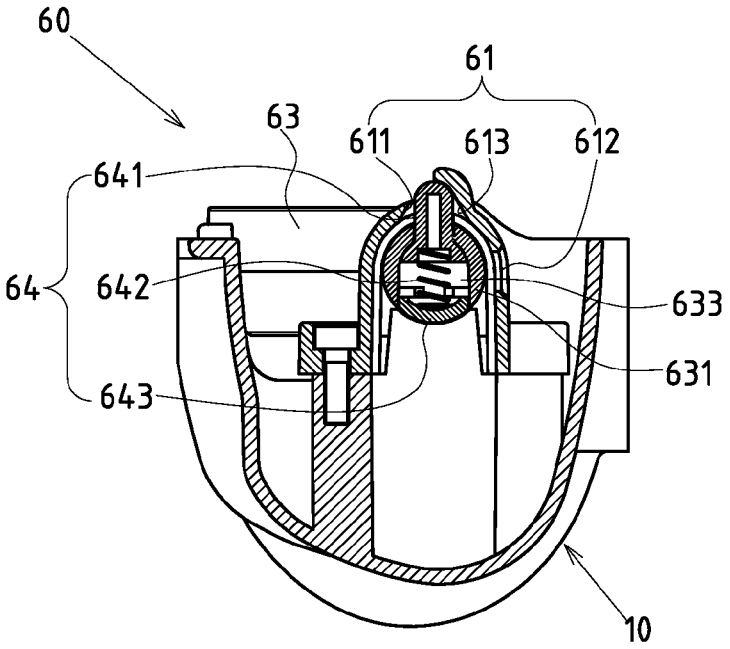
FIG. 6 is a cross-sectional view of the rocking device in FIG. 4 when the present invention is used as a baby walker.
Figure 7:
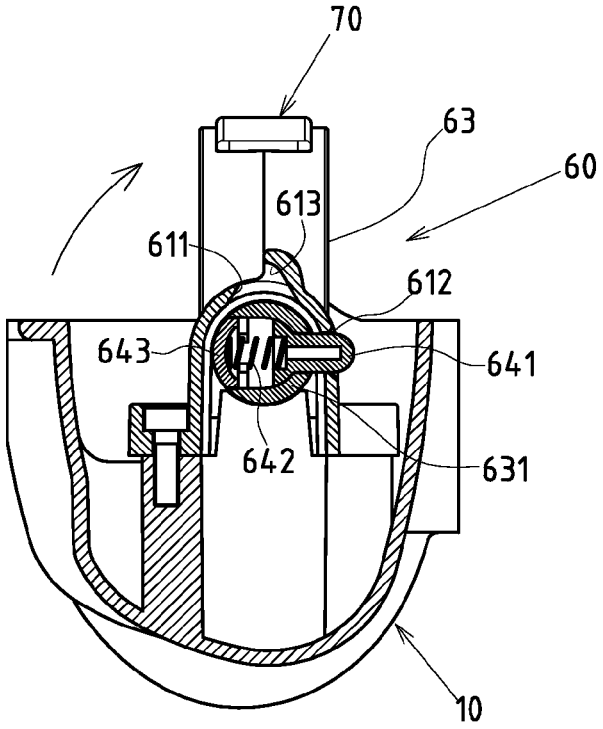
FIG. 7 is a cross-section view of the rocking device in FIG. 4 when the present invention is used as a rocking chair.
Figure 8:
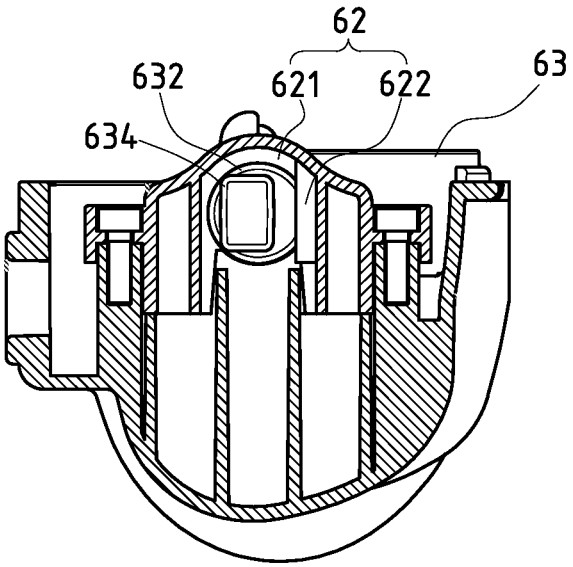
FIG. 8 is another cross-sectional view of the rocking device in FIG. 4 when the present invention is used as a baby walker.
Figure 9:
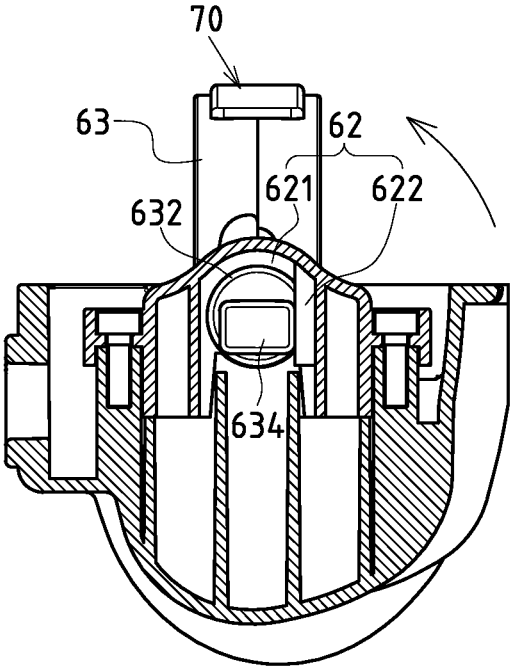
FIG. 9 is another cross-section view of the rocking device in FIG. 4 when the present invention is used as a rocking chair.
Figure 10:
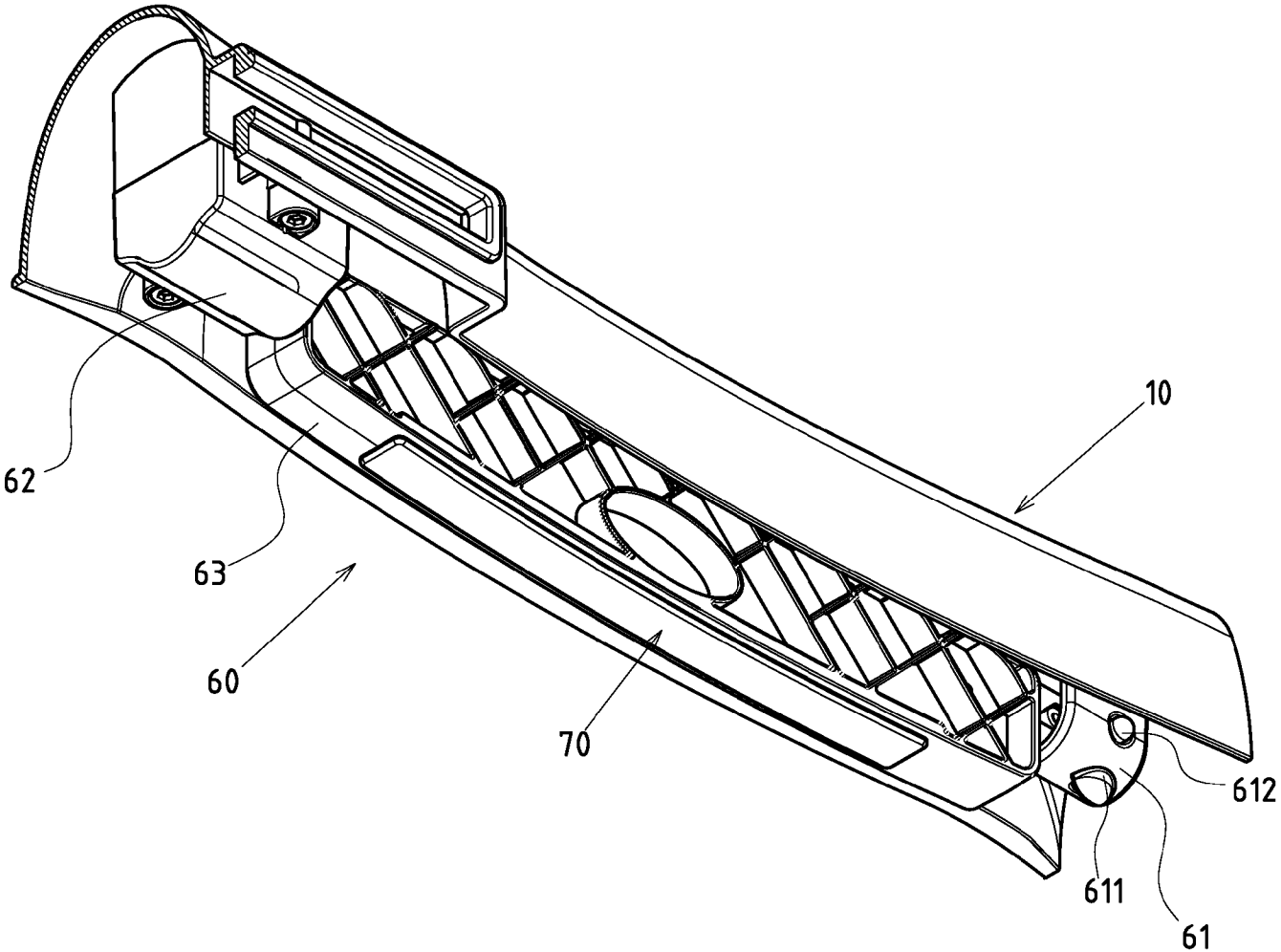
FIG. 10 is a perspective view of the rocking device of the baby walker in accordance with the present invention when the baby walker is used as a rocking chair.
Figure 11:
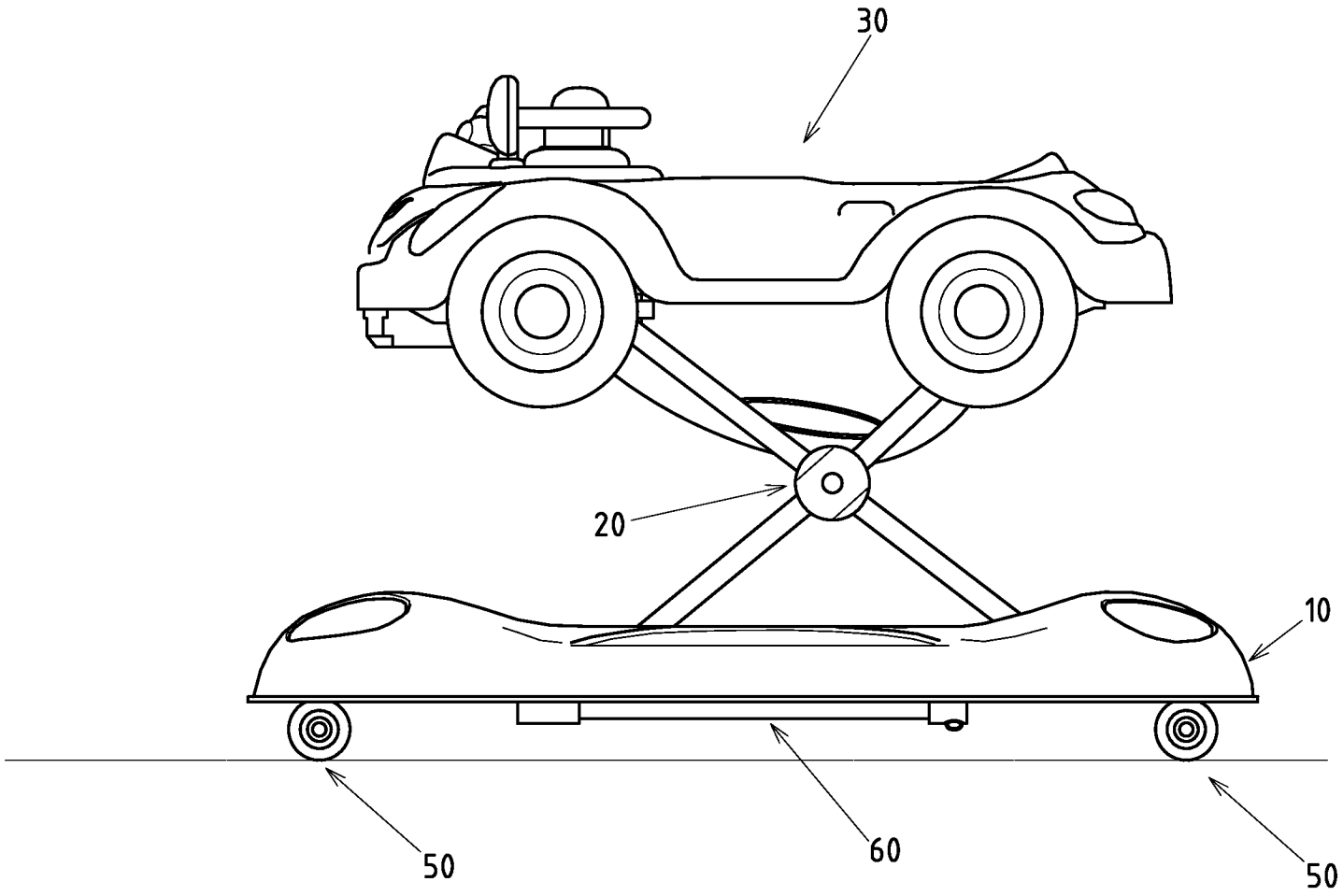
FIG. 11 is a side plan view of the baby walker in accordance with the present invention when the present invention is used as a baby walker.
Figure 12:
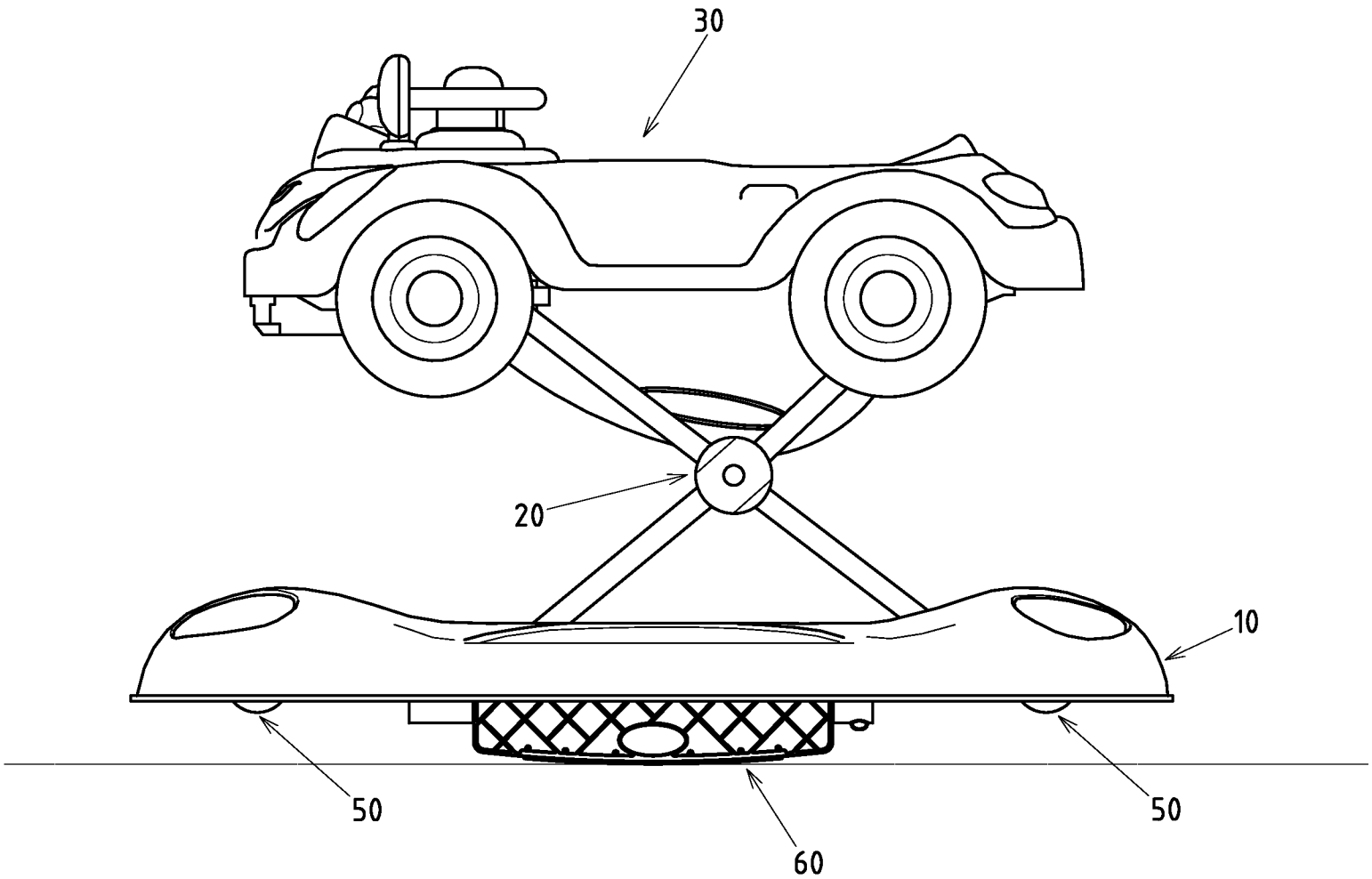
FIG. 12 is a side plan view of the baby walker in accordance with the present invention when the present invention is used as a rocking chair.

With reference to FIG. 3, each roller assembly 50 includes a seat 51 securely mounted on the bottom of the lower frame 10 and a trough 511 is defined in the seat 51. The trough 511 has a back and a top vertically corresponding to each other. A first hole 512 and a second hole 513 are respectively defined in the back and the top of the trough 511. An arm 52 is pivotally mounted into the trough 511. The arm 52 includes a block 521 rotatably received in the trough 511 and a shaft 522 longitudinally and rotatably inserted into the block 521, wherein a roller is rotatably mounted onto a free end of the shaft 522. The block 521 has an engager 53 disposed therein and reciprocally moved relative to the block 521. The roller assembly 60 is maintained in a folding condition and the arm 52 is horizontal relative to a supporting face, which supporting the baby walker, when the engager 53 is engaged into the first hole 512. The roller assembly 60 is maintainer in a stretching condition and the arm is vertical relative to the supporting face when the engager 53 is engaged into the second hole 513.

With reference to FIGS. 4 to 10, each rocking device 60 includes a first seat 61 and a second seat 62 respectively securely mounted on the bottom of the lower frame 10. A rocking plate 63 has two opposite ends respectively pivotally mounted into a corresponding one of the first seat 61 and the second seat 62. The rocking plate 63 has a straight side and a corresponding curved side, wherein the curved side of the rocking plate 63 has an anti-slip strap secured thereon. The straight side of the rocking plate 63 includes two opposite ends respectively having a first axle 631 and a second axle 632 horizontally extending therefrom. A switching set 64 is disposed in the first axle 631 for selectively positioning the rocking plate 63. A first through hole 611 and a second through hole 612 are respectively defined in the first seat 61, wherein the first through hole 611 has an axis perpendicularly to that of the second through hole 612. The switching set 64 respectively coordinates the first through hole 611 and the second through hole 612 to hold the rocking plate 63 in place when the rocking plate 63 is folded and stretched. The first through hole 611 is formed with an inclined face 613 toward the second through hole 612. A room 633 is defined in the first axle 631 for receiving the switching set 64. The switching set 64 includes a button 641 and a spring 642 sequentially mounted into the room 633, and an end piece 643 is mounted on to the first axle 631 for closing the room 633 and holding the button 641 and the spring 642 in the room 633. The button 641 extends through the first axle 631 and is reciprocally moved relative to the first axle 631 due to the restitution force of the spring 642. A cubic stub 634 longitudinally and eccentrically extends from a distal end of the second axle 632. A cavity 621 is defined in the second seat 62 for rotatably receiving the second axle 632, wherein a stopper 622 is formed on an interior of the cavity 621 for limiting a rotating angle of the cubic stub 634.

By the structures as described above, the operating method is described hereinafter. With reference to FIGS. 3, 4, 6, 8 and 11, as shown, the baby walker in accordance with the present invention provides a function as a general baby walker. In the embodiment, the engager 53 of each of the roller assemblies 50 is engaged into a corresponding one of the second holes 513 such that each roller assembly 50 is stretched and vertical relative to the support face. The button 641 of the switching set 64 of each of the rocking device 60 is engaged into a corresponding one of the first through holes 611 such that each rocking plate 63 is in a condition of folded and parallel to the supporting face. In the manner, the baby walker in accordance with the present invention grounds the supporting face by the rollers 523 such that the baby on the baby walker can kick his/her legs on the supporting face and slide on the supporting face.

With reference to FIGS. 3, 7, 9, 10 and 12, as shown, the baby walker in accordance with the present invention is used as a rocking chair. In the embodiment, the shaft 522 of each roller assembly 50 is upwardly folded and the engager 53 is moved and engaged into a corresponding one of the first holes 512 to make the shaft 522 being parallel to the supporting face. Then, the two rocking plates 63 are turned. The distal end of the button 641 is moved along inclined face 613 to gradually compress the spring when the rocking plate 63 being turning. The distal end of the button 641 is automatically engaged into a corresponding one of the second through holes 612 due to the restitution force of the spring 642 when the rocking plate 63 is vertical relative to the supporting face. At the same time, one side of the cubic stub 634 abuts against the stopper 622 to prevent the rocking plate 63 from being overly turned and ensure that the rocking plate 63 vertically corresponds to the supporting face when the rocking device 60 is in a condition of stretch. As described above, the operator can easily turn the rocking plate 63 when stretching the rocking device 60 because the inclined face 613 can smoothly guide the distal end of the engager 53 into the second through hole 612. In addition, the distal end of the engager 53 is received and limited in the second through hole 612 such that the rocking plate 63 would not be automatically folded due to an improper operation. The operator must inwardly pushed the engager 53 to make the distal end of the engager 53 disengaged from the second through hole 612 and the rocking plate 63 can be turned again when folding the rocking device 60. This design can promote the safety of the baby walker such that the baby can train the coordination of his/her muscle under a condition without any danger.

However, when providing a function as a rocking chair, the roller assemblies 50 would not be folded when the height of the rocking plate 63 is greater than that of the roller assembly 50.

Furthermore, the baby walker can be also used as a general chair to support the baby's body when the roller assemblies 50 and the rocking devices 60 are folded, and baby walker grounds the supporting face by the lower frame 10. In this condition, the baby walker in accordance with the present invention cannot be easily moved such that the caregiver can easily feed the baby or wash his/her face. In addition, the caregiver can temporarily leave for preparing milk or food because the baby cannot be moved by the baby walker when the roller assemblies 50 and the rocking devices 60 are all folded.

The baby walker in accordance with the present invention has a new structures and technical characteristics such that the baby walker of the present invention is multi-functional, such as baby walker and rocking chair, and promote the safety of the conventional baby walker in accordance with the prior art.

Although the invention has been explained in relation to its preferred embodiment, it is to be understood that many other possible modifications and variations can be made without departing from the spirit and scope of the invention as hereinafter claimed.

I claim:

1. A baby walker comprising a lower frame and an upper frame mounted onto the lower frame via a folding device, wherein the upper frame is provided to load the body weight of the user, the lower frame having multiple roller assemblies universally mounted on a bottom thereof and two parallel foldable rocking devices mounted on the bottom of the lower frame, wherein:

each roller assembly including a seat securely mounted on the bottom of the lower frame, an arm pivotally mounted on the seat and a roller rotatably mounted to a free end of the arm, wherein the seat holds the arm in place when the arm vertically and horizontally corresponds to a supporting face of the baby walker; and each rocking device including a first seat and a second seat respectively securely mounted on the bottom of the lower frame, a rocking plate having two opposite ends respectively pivotally mounted into a corresponding one of the first seat and the second seat, the rocking plate having a straight side and a corresponding curved side, and the straight side of the rocking plate including two opposite ends respectively having a first axle and a second axle horizontally extending therefrom, wherein the first axle and the second axle respectively rotatably received in the first seat and the second seat, the first seat holding the rocking plate in place when the rocking plate is vertical and horizontal relative to the supporting face of the baby walker.

2. The baby walker as claimed in claim 1, wherein the rocking device includes a switching set disposed in the first axle for selectively positioning the rocking plate, a first through hole and a second through hole respectively defined in the first seat, wherein the first through hole has an axis perpendicularly to that of the second through hole, the switching set respectively coordinating the first through hole and the second through hole to hold the rocking plate in place when the rocking plate is vertical and horizontal relative to the supporting face of the baby walker.

3. The baby walker as claimed in claim 2, wherein the first through hole is formed with an inclined face toward the second through hole and a room is defined in the first axle for receiving the switching set, the switching set including a button and a spring sequentially mounted into the room, and an end piece mounted on to the first axle for closing the room and holding the button and the spring in the room, the inclined face provides a guiding function when the button is moved from the first through hole to the second through hole.

4. The baby walker as claimed in claim 1, wherein the second axle includes a cubic stub longitudinally and eccentrically extending from a distal end thereof, a cavity defined in the second seat for rotatably receiving the second axle, wherein a stopper is formed on an interior of the cavity for limiting a rotating angle of the cubic stub.

5. The baby walker as claimed in claim 2, wherein the second axle includes a cubic stub longitudinally and eccentrically extending from a distal end thereof, a cavity defined in the second seat for rotatably receiving the second axle, wherein a stopper is formed on an interior of the cavity for limiting a rotating angle of the cubic stub.

6. The baby walker as claimed in claim 3, wherein the second axle includes a cubic stub longitudinally and eccentrically extending from a distal end thereof, a cavity defined in the second seat for rotatably receiving the second axle, wherein a stopper is formed on an interior of the cavity for limiting a rotating angle of the cubic stub.

7. The baby walker as claimed in claim 1, wherein the seat includes a trough defined therein, the trough having a back and a top vertically corresponding to each other, a first hole and a second hole respectively defined in the back and the top of the trough, the arm including a block rotatably received in the trough and a shaft longitudinally and rotatably inserted into the block, wherein the roller is rotatably mounted onto a free end of the shaft, the block having an engager disposed therein and reciprocally moved relative to the block, the roller assembly maintained in a folding condition and the arm being horizontal relative to the supporting face when the engager is engaged into the first hole, and the roller assembly maintainer in a stretching condition and the arm being vertical relative to the supporting face when the engager is engaged into the second hole.

8. The baby walker as claimed in claim 2, wherein the seat includes a trough defined therein, the trough having a back and a top vertically corresponding to each other, a first hole and a second hole respectively defined in the back and the top of the trough, the arm including a block rotatably received in the trough and a shaft longitudinally and rotatably inserted into the block, wherein the roller is rotatably mounted onto a free end of the shaft, the block having an engager disposed therein and reciprocally moved relative to the block, the roller assembly maintained in a folding condition and the arm being horizontal relative to the supporting face when the engager is engaged into the first hole, and the roller assembly maintainer in a stretching condition and the arm being vertical relative to the supporting face when the engager is engaged into the second hole.

9. The baby walker as claimed in claim 3, wherein the seat includes a trough defined therein, the trough having a back and a top vertically corresponding to each other, a first hole and a second hole respectively defined in the back and the top of the trough, the arm including a block rotatably received in the trough and a shaft longitudinally and rotatably inserted into the block, wherein the roller is rotatably mounted onto a free end of the shaft, the block having an engager disposed therein and reciprocally moved relative to the block, the roller assembly maintained in a folding condition and the arm being horizontal relative to the supporting face when the engager is engaged into the first hole, and the roller assembly maintainer in a stretching condition and the arm being vertical relative to the supporting face when the engager is engaged into the second hole.

10. The baby walker as claimed in claim 4, wherein the seat includes a trough defined therein, the trough having a back and a top vertically corresponding to each other, a first hole and a second hole respectively defined in the back and the top of the trough, the arm including a block rotatably received in the trough and a shaft longitudinally and rotatably inserted into the block, wherein the roller is rotatably mounted onto a free end of the shaft, the block having an engager disposed therein and reciprocally moved relative to the block, the roller assembly maintained in a folding condition and the arm being horizontal relative to the supporting face when the engager is engaged into the first hole, and the roller assembly maintainer in a stretching condition and the arm being vertical relative to the supporting face when the engager is engaged into the second hole.

11. The baby walker as claimed in claim 5, wherein the seat includes a trough defined therein, the trough having a back and a top vertically corresponding to each other, a first hole and a second hole respectively defined in the back and the top of the trough, the arm including a block rotatably received in the trough and a shaft longitudinally and rotatably inserted into the block, wherein the roller is rotatably mounted onto a free end of the shaft, the block having an engager disposed therein and reciprocally moved relative to the block, the roller assembly maintained in a folding condition and the arm being horizontal relative to the supporting face when the engager is engaged into the first hole, and the roller assembly maintainer in a stretching condition and the arm being vertical relative to the supporting face when the engager is engaged into the second hole.

12. The baby walker as claimed in claim 6, wherein the seat includes a trough defined therein, the trough having a back and a top vertically corresponding to each other, a first hole and a second hole respectively defined in the back and the top of the trough, the arm including a block rotatably received in the trough and a shaft longitudinally and rotatably inserted into the block, wherein the roller is rotatably mounted onto a free end of the shaft, the block having an engager disposed therein and reciprocally moved relative to the block, the roller assembly maintained in a folding condition and the arm being horizontal relative to the supporting face when the engager is engaged into the first hole, and the roller assembly maintainer in a stretching condition and the arm being vertical relative to the supporting face when the engager is engaged into the second hole.

* * * * *